US005785150A

United States Patent [19]

Tominaga et al.

[11] Patent Number: 5,785,150

[45] Date of Patent: Jul. 28, 1998

[54] SWASH PLATE TYPE AXIAL PISTON PUMP INCLUDING LUBRICATION MECHANISM, AND VALVE PLATE

[75] Inventors: Tsutomu Tominaga; Tatsuya Ikegami; Kazuyoshi Yamamoto; Osamu Matsumoto; Kazuyuki Ushio, all of Tokyo; Kyoya Igarashi, Kanagawa; Tateo Kume, Aichi; Nobuaki Murakami, Kyoto; Hideyuki Oda, Aichi, all of Japan

[73] Assignees: Mitsubishi Denki Kabushiki Kaisha; Mitsubishi Jidosha Kogyo Kabushiki Kaisha, both of Tokyo, Japan

[21] Appl. No.: 805,006

[22] Filed: Feb. 24, 1997

[30] Foreign Application Priority Data

Feb. 22, 1996 [JP] Japan ..... 8-035019

[51] Int. Cl.[6] ..... F01M 1/00

[52] U.S. Cl. ..... 184/6.17; 92/57; 92/154; 417/269

[58] Field of Search ..... 92/57, 153, 154; 184/6.17; 417/269

[56] References Cited

U.S. PATENT DOCUMENTS

| | | | |
|---|---|---|---|
| 3,037,489 | 6/1962 | Douglas | 92/154 |
| 3,131,605 | 5/1964 | LaBorde | 92/57 |
| 4,014,250 | 3/1977 | Bosch | 92/57 |
| 5,205,124 | 4/1993 | Budzich | 184/6.17 |

FOREIGN PATENT DOCUMENTS

| | | | |
|---|---|---|---|
| 1-130073 | 5/1989 | Japan . | |
| 812202 | 4/1959 | United Kingdom | 184/6.17 |

*Primary Examiner*—Thomas E. Denion

*Attorney, Agent, or Firm*—Sughrue, Mion, Zinn, Macpeak & Seas, PLLC

[57] ABSTRACT

In a swash plate type axial piston pump, a swash plate 23 is fixed and supported in a cabinet while being inclined with respect to the center axial line of a rotary shaft 3. A cylinder block 15 having a plurality of cylinders 13 is attached to the rotary shaft 3 so that the cylinder block 15 slides of the rotary shaft 3 in the axial direction thereof and is rotated integrally therewith. Each one end of a plurality of pistons 21 is slidingly engaged with the cylinder 13 and the other end thereof is abutted against the swash plate 23 through a shoe 25. A valve plate 31 having a suction port 33 and a discharge port 35 is disposed so as to be abutted against the inner surface of the cabinet 1 and the bottom the cylinder block 15 so that a suction path 39 and a discharge path 41 in the cabinet 1 are selectively communicated with a pump chamber 14 in each cylinder through the suction port 33 and the discharge port 35. An operating oil is supplied to the sliding portion between the valve plate 31 and the bottom of the cylinder block 15 by a lubrication means. With this arrangement, since the operating oil is positively supplied to the sliding portion being rotated of the swash plate type axial piston pump, the sliding portion is sufficiently lubricated even if the pump is started to thereby prevent the dry state of the pump.

9 Claims, 5 Drawing Sheets

SWASH PLATE TYPE AXIAL PISTON PUMP INCLUDING LUBRICATION MECHANISM, AND VALVE PLATE

BACKGROUND OF THE INVENTION

1. Field of the Invention

The present invention relates to a lubrication mechanism for lubricating the sliding surface between members rotated at a high speed under a high pressure in a swash plate type axial pump and the like and a valve plate used in the swash plate type axial pump, and more specifically, to a valve plate disposed at a portion where an operating fluid is sucked from a suction path defined to a cabinet into a plurality of cylinders, which are rotatably accommodated in the cabinet and driven in rotation, as well as discharged from the cylinders into a discharge path defined to the cabinet and controlling the charge and discharge of the operating fluid in the swash plate type axial pump and the like.

2. Description of the Related Art

Conventionally, there is known a swash plate type axial pump such as the one disclosed in Japanese Patent Publication No. 4-68472. FIG. 8 is a side cross sectional view of the swash plate type axial pump shown in the publication.

In the drawing, a rotary shaft 103 disposed in a cabinet 101 is rotatably supported by the cabinet 101 at the both ends thereof through bearings composed of a roller bearing 105 and a needle bearings 107, respectively with one end of the rotary shaft 103 coupled with a not shown drive source. A cylinder block 111 having a plurality of cylinders 109 is engaged with the rotary shaft 103 through a spline 113 so that the cylinder block 111 is rotated integrally with the rotary shaft 103 and slidable in an axial direction. A plurality of the cylinders 109 formed to the cylinder block 111 are disposed around the rotary shaft 103 at approximately equal intervals and a piston 115 is reciprocatingly slidably engaged with each of the cylinders 109. Further, an annular swash plate 117 is loosely engaged with the rotary shaft 103. The swash plate 117 has one side against which one end of each of the respective pistons 115 is abutted through a shoe 119 and the other side formed to a cylindrical shape and abutted against the cylindrical surface of a holder 121 disposed to the cabinet 101. The respective shoes 119 are held by the swash plate 117 through annular retainers 123 and one end of each piston 115 is pivotally mounted on the spherical portion 119a of each shoe 119. The outer periphery of the swash plate 117 is coupled with a plunger 127 through a coupling arm 125 and the swash plate 117 can be inclined within a certain range with respect to the center axis line of the rotary shaft 103 when the plunger 127 is actuated.

A valve plate 129 is interposed between the bottom of the cylinder block 111 and the inner surface of the cabinet 101 and a suction port 131 and a discharge port 133 are defined to the valve plate 129. The cylinder block 111 is urged toward a left direction in FIG. 8 by a coil spring 135 wound around the outer periphery of the rotary shaft 103 to thereby press the bottom surface of the cylinder block 111 against the inner surface of the cabinet 101 through the valve plate 129.

Pump chambers 110 partitioned in the respective cylinders 109 in the cylinder block 111 are selectively communicated with a suction path 137 or a discharge path 139 defined in the cabinet 101 through the suction port 131 or the discharge port 133 of the valve plate 129 as the cylinder block 111 is rotated by the rotation of the rotary shaft 103.

In the above arrangement, when the rotary shaft 103 is driven in rotation by operating the not shown drive source after the inclined angle of the swash plate 117 is suitably adjusted with respect to the rotary shaft 103 by actuating the plunger 127, the cylinder block 111 is rotated together with the rotary shaft 103 so that the pistons 115 in the cylinders 109 are rotated together with the cylinder block 111. Since one ends of the respective pistons 115 are abutted against the swash plate 117 inclined with respect to the rotary shaft 103 through the shoes 119, the pistons 115 make a reciprocating motion in the cylinders 109 as they turn around the rotary shaft. Consequently, in a suction stroke in which the piston 115 moves toward a right direction in FIG. 8, an operating fluid is sucked into the pump chamber 110 in the cylinder 109 from the suction path 137 through the suction port 131 of the valve plate 129. Whereas, in a discharge stroke in which the piston 115 moves toward a left direction in FIG. 8, the operating fluid in the pump chamber 110 is pressurized and discharged to the discharge path 139 in the cabinet 101 through the discharge port 133 of the valve plate 129.

In the swash plate type axial pump arranged as described above, although the bottom of the cylinder block 111 is rotated while being slid against the valve plate 129 when the pump is in operation, a fluid supplying mechanism for supplying an operating fluid to the sliding portion is not particularly provided and the sliding portion is lubricated in only such a degree that the operating fluid accumulated on the bottom of the cabinet 101 while the pump operates is naturally supplied to the sliding portion by being splashed up thereto by the rotation of the cylinder block 111. Further, the one of the ends of the rotary shaft 103 accommodated in the cabinet 101 is rotatively supported by the cabinet 101 through the needle bearing 107, the operating fluid is not positively supplied to the needle bearings 107 except that the operating fluid accumulated in the cabinet 101 is naturally supplied thereto.

Therefore, when the pump is driven at a high speed, the sliding surface between the bottom of the cylinder block 111 and the valve plate 129 and the needle bearings 107 are insufficiently lubricated. Thus, a problem arises in that these portions are abruptly worn and inadequately work, their life is greatly shortened, an abnormal sound is generated and a noise is abnormally increased because these portions are made to a dry state.

Further, when the swash plate type axial pump is used as a pump for supplying fuel to injectors of a fuel injection type engine, fuel remaining in the pump is evaporated by the heat of the engine when the pump stops. Thus, when the pump is started, it is liable to be operated in a dry state.

An object of the present invention made to solve the above conventional problem is to provide a swash plate type axial pump including a lubrication mechanism, and a valve plate capable of sufficiently making lubrication even if the pump rotates at a high speed or even if the pump is restarted after it is stopped and preventing the dry state of the pump.

SUMMARY OF THE INVENTION

According to one aspect of the present invention, there is provided a swash plate type axial pump including a lubrication mechanism, which comprises a cabinet, a rotary shaft disposed in the cabinet, rotatively supported by the cabinet at the both ends thereof through bearings and capable of being driven in rotation by a drive source, a swash plate disposed in the cabinet and fixed and supported by being inclined with respect to the center axial line of the rotary shaft, a cylinder block attached to the rotary shaft so as to be slidable in the axial direction of the rotary shaft and rotated integrally with the rotary shaft and including a plurality of cylinders each having a pump chamber partitioned therein, a plurality of pistons each having one end slidably engaged with the cylinder and the other end coupled with a shoe abutted against the swash plate, a suction path disposed in the cabinet for supplying an operating fluid into the pump chambers in the respective cylinders from the outside, a discharge path disposed in the cabinet for discharging the operating fluid from the pump chambers in the respective cylinders to the outside, a valve plate disposed to abut one end surface against the inner surface of the cabinet and the other end surface against the bottom of the cylinder block, causing the rotary shaft to pass therethrough and having a suction port and a discharge port for causing the suction path and the discharge path to selectively communicate with the pump chambers in the respective cylinders, and lubrication means for supplying a lubrication oil to the portion where the valve plate is in contact with the bottom of the cylinder block.

In a preferred form of the invention, the lubrication means is composed of a lubricating hole defined by passing through the valve plate with one end of the lubricating hole communicating with the suction path and the other end thereof opened to the end surface of the valve plate abutted against the bottom of the cylinder block.

In another preferred form of the invention, the valve plate has a center hole for causing the rotary shaft to pass therethrough, an outer peripheral land portion projecting along the outer peripheral edge of the end surface thereof abutted against the bottom of the cylinder block, a seal land portion defined on the end surface between the center hole and the outer peripheral land portion, the suction port and the discharge port defined by passing through the seal land portion for communicating the suction path and the discharge path with the pump chambers in the cylinders, respectively and an annular groove defined between the outer peripheral land portion and the seal land portion and the other end of the lubricating hole is opened to the annular groove.

In a further preferred form of the invention, the valve plate has a center hole for causing the rotary shaft to pass therethrough, an outer peripheral land portion projecting along the outer peripheral edge of the end surface thereof abutted against the bottom of the cylinder block, a seal land portion defined on the end surface between the center hole and the outer peripheral land portion, the suction port and the discharge port defined by passing through the seal land portion for communicating the suction path and the discharge path with the pump chambers in the cylinders, respectively and an annular groove defined between the outer peripheral land portion and the seal land portion and the other end of the lubricating hole is opened to the outer peripheral land portion.

In a further preferred form of the invention, the valve plate has a center hole for causing the rotary shaft to pass therethrough, an outer peripheral land portion projecting along the outer peripheral edge of the end surface thereof abutted against the bottom of the cylinder block, at least one cutout portion defined to the outer peripheral land portion, a seal land portion defined on the end surface between the center hole and the outer peripheral land portion, the suction port and the discharge port defined by passing through the seal land portion for communicating the suction path and the discharge path with the pump chambers in the cylinders, respectively and an annular groove defined between the outer peripheral land portion and the seal land portion and the other end of the lubricating hole is opened to the cutout groove.

In a further preferred form of the invention, a bearing lubricating path is defined to the cabinet to supply an operating fluid to the bearing for rotatively supporting the end of the rotary shaft near to the valve plate from the suction path in the cabinet.

In another aspect of the present invention, there is provided a valve plate comprising an annular body and the valve plate includes a center hole, an outer peripheral land portion disposed on an end surface of the annular body along the outer peripheral edge thereof, a seal land portion defined on the end surface of the annular body between the center hole and the outer peripheral land portion, an arc- shaped suction port and an arc-shaped discharge port defined to the seal land portion by passing therethrough, an annular groove defined between the outer peripheral land portion and the seal land portion and a lubricating hole defined by passing through the annular groove.

In a further aspect of the present invention, there is provided a valve plate comprising an annular body having a center hole and the valve plate includes an outer peripheral land portion disposed on an end surface of the annular body along the outer peripheral edge thereof, a lubricating hole defined by passing through the outer peripheral land portion, a seal land portion defined on the end surface between the center hole and the outer peripheral land portion, an arc-shaped suction port and discharge port defined to the seal land portion by passing therethrough and an annular groove defined between the outer peripheral land portion and the seal land portion.

In a further aspect of the present invention, there is provided a valve plate comprising an annular body having a center hole and the valve plate includes an outer peripheral land portion disposed on an end surface of the annular body along the outer peripheral edge thereof, a cutout groove defined to the outer peripheral land portion, a lubricating hole defined by passing through the cutout groove, a seal land portion defined on the end surface between the center hole and the outer peripheral land portion, an arc-shaped suction port and discharge port defined by passing through the seal land portion and an annular groove defined between the outer peripheral land portion and the seal land portion.

DESCRIPTION OF PREFERRED EMBODIMENTS

Embodiments of the present invention will be described below with reference to the drawings.

Embodiment 1

Figure 1:
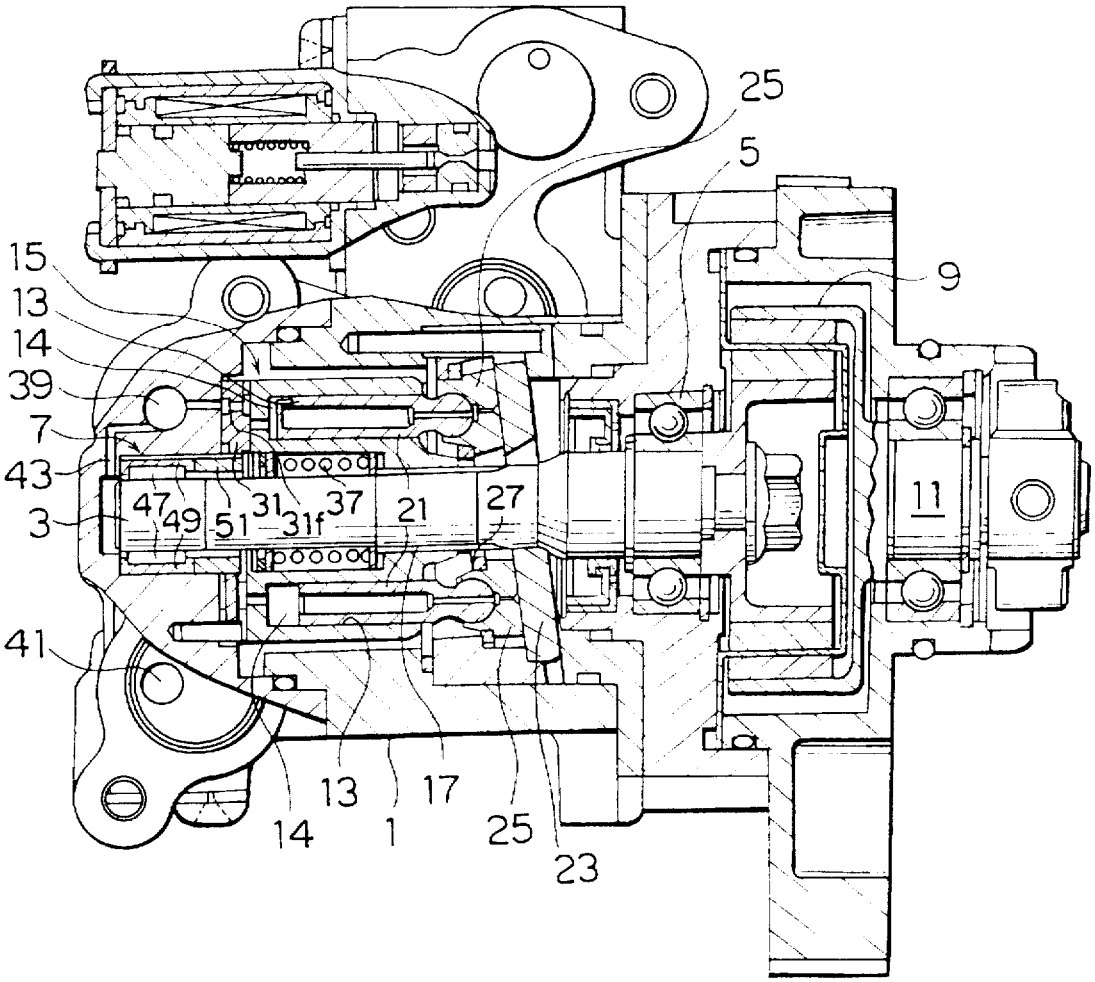
FIG. 1 is a longitudinal side cross sectional view of a swash plate type axial pump including a lubrication mechanism according to an embodiment of the present invention.
Figure 2:
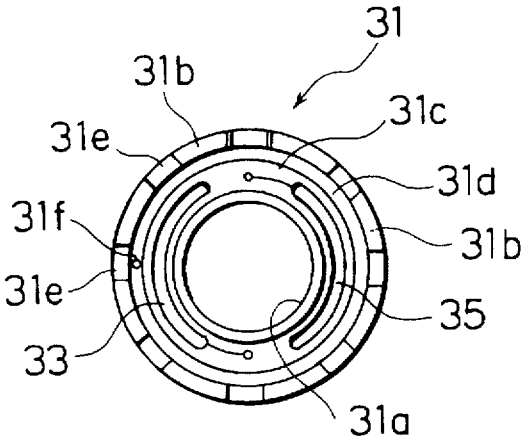
FIG. 2 is a plan view of a valve plate of the pump.
Figure 3:
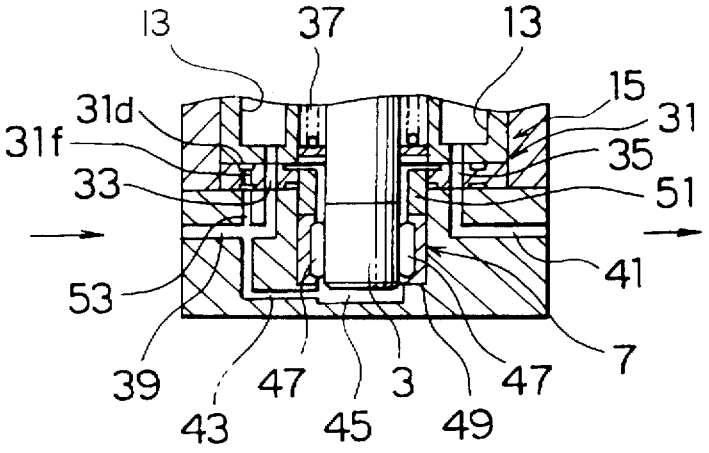
FIG. 3 is a longitudinal side cross sectional view of a portion in the vicinity of the valve plate.

FIG. 1–FIG. 3 show a first embodiment of a swash plate type axial pump including a lubrication mechanism according to the present invention, wherein FIG. 1 is a longitudinal cross sectional side view of the pump and FIG. 2 is a plan view of a valve plate and FIG. 3 is a longitudinal side cross sectional view of a portion in the vicinity of the valve plate.

In FIG. 1, a rotary shaft 3 is accommodated in a cabinet 1 and one end of the rotary shaft 3 is rotatively supported by the cabinet 1 through a bearing such as a ball bearing 5 or the like and the other end of the rotary shaft 3 is rotatively supported thereby through a bearing such as a needle bearing 7 or the like, respectively. The one end of the rotary shaft 3 is coupled with an input shaft 11 through a magnet coupling 9 and the input shaft 11 is coupled with a not shown drive source such as an internal combustion engine or the like.

A cylinder block 15 having a plurality of cylinders 13 is engaged with the rotary shaft 3 through a spline 17 so that the cylinder block 15 is rotated integrally with the rotary shaft 3 and slidable in an axial direction. A plurality of the cylinders 13 formed to the cylinder block 15 are disposed around the rotary shaft 3 at approximately equal intervals and a piston 21 is reciprocatingly slidably engaged with each of the cylinders 13.

An annular swash plate 23 is loosely engaged with the rotary shaft 3 and fixed to and held by the cabinet 1 in a state that it is inclined with respect to the center axial line of the rotary shaft 3 at the outer periphery thereof. One end of each piston 21 is abutted against one side of the swash plate 23 through a shoe 25 and each shoe 25 is slidably supported on the one side of the swash plate 23 by an annular shoe holder 27.

A valve plate 31 is interposed between the bottom of the cylinder block 15 and the inner surface of the cabinet 1 and a suction port 33 and a discharge port 35 are defined to the valve plate 31. The cylinder block 15 is urged toward a left direction in FIG. 1 by a coil spring 37 wound around the outer periphery of the rotary shaft 3 to thereby press the bottom surface of the cylinder block 15 against the inner surface of the cabinet 1 through the valve plate 31. Pump chambers 14 partitioned in the respective cylinders 13 in the cylinder block 15 are selectively communicated with a suction path 39 or a discharge path 41 defined in the cabinet 1 through the suction port 33 or the discharge port 35 of the valve plate 31 as the cylinder block 15 is rotated by the rotation of the rotary shaft 3.

The suction path 39 communicates with an oil sump 45 formed in the cabinet 1 on the end of the rotary shaft 3 rotatively supported by the needle bearing 7 through a bearing lubricating path 43 defined in the cabinet 1 and a portion of an operating fluid is introduced from the suction path 39 to the oil sump 45 through the bearing lubricating path 43 to lubricate the needle bearing 7.

As shown in FIG. 3, the needle bearing 7 is composed of a plurality of needle-shaped rollers 47 disposed between the rotary shaft 3 and an outer ring 49 at equal intervals and the outer ring 49 is fixed to the cabinet 1 by a strip ring 51.

As shown FIG. 2, the valve plate 31 is composed of an annular body having a center hole 31*a* through which the rotary shaft 3 rotatively passes, the suction port 33 and the discharge port 35. The annular body has an outer peripheral land portion 31*b* projecting along the outer peripheral edge of at least one end surface thereof, a seal land portion 31*c* defined between the center hole 31*a* and the outer peripheral land portion 31*b* and an annular groove 31*d* defined between the outer peripheral land portion 31*b* and the seal land portion 31*c*. The seal land portion 31*c* has the suction port 33 and the discharge port 35 formed thereto in an arc state symmetrically with respect to the center of the annular body to communicate the suction path 39 and the discharge path 41 with the pump chambers 14 in the respective cylinders 13. With this arrangement, when the valve plate 31 relatively slides on the bottom of the cylinder block 15, the operating fluid leaked from suction port 33 and the discharge port 35 through the sliding portion is sealed by the seal land portion 31*c*. At least one cutout groove 31*e* is defined to the outer peripheral land portion 31*b*. In the example shown in the drawing, a plurality of the cutout grooves 31*e* are defined in a peripheral direction at substantially equal intervals so that the outer peripheral land portions 31*b* and the cutout grooves 31*e* are alternately disposed. Further, in the example shown in the drawing, the other end surface of the annular body is arranged similarly to that of the aforesaid one end surface. However, since the other end surface of the valve plate 31 does not slide, the annular groove 31*d*, the cutout groove 31*e* of the outer peripheral land portion 31*b* and the like are not necessarily defined to the other end surface.

Further, the annular body has a lubricating hole 31*f* passing through the both end surfaces thereof which serves as a lubricating means for supplying the operating fluid to the outer peripheral land portion 31*b*, the seal land portion 31*c* and the annular groove 31*d*. In the embodiment, one end of the lubricating hole 31*f* is opened to the annular groove 31*d* as well as the other end thereof communicates with the suction path 39 through a fluid path 53.

Next, operation of the embodiment will be described below.

When the rotary shaft 3 is driven in rotation by operating the not shown drive source, the cylinder block 15 is rotated together with the rotary shaft 3 so that the pistons 21 in the cylinders 13 are rotated together with the cylinder block 15. Since the one ends of the pistons 21 are abutted against the swash plate 23 fixed to and held by the cabinet 1 in the state that it is inclined with respect to the center axial line of the rotary shaft 3, the pistons 21 make a reciprocating motion in the cylinder 13 as they turn around the rotary shaft 3. Therefore, in a suction stroke in which the piston 21 moves toward a right direction in FIG. 1, the pump chamber 14 in the cylinder 13 communicates with the suction port 33 of the valve plate 31 as the cylinder block rotates, so that the operating fluid is sucked into the pump chamber 14 in the cylinder 13 from the suction path 39 in the cabinet 1 through the suction port 33 of the valve plate 31. Further, in a discharge stroke in which the piston 21 moves toward a left direction in FIG. 1, since the pump chambers 14 communicate with the discharge port 35 of the valve plate 31, the operating fluid in the pump chamber 14 is pressurized and discharged to the discharge path 41 in the cabinet 1 through the discharge port 35 of the valve plate 31.

When the operating fluid is supplied to and discharged from the pump chambers 14, the operating fluid leaked from the suction port 33 and the discharge port 35 through the sliding portion between the bottom of the cylinder block 15 being rotated and the valve plate 31 is sealed by the seal land portion 31*c* of the valve plate 31. Further, a portion of the operating fluid in the suction path 39 of the cabinet 1 is introduced to the annular groove 31*d* on the surface of the valve plate 31 through the fluid path 53 and the lubricating hole 31*f* in the valve plate 31 and supplied therefrom to the outer peripheral land portion 31*b* and the seal land potion 31*c* to lubricate these land portions 31*b* and 31*c* and the bottom of the cylinder block 15. As a result, even if the pump is restarted after it is stopped, the sliding portion between the valve plate 31 and the cylinder block 15 is sufficiently lubricated, thus the pump can be securely prevented from being operated in a dry state which was caused conventionally.

Since a portion of the operating fluid in the suction path 39 is introduced to the oil sump 45 through the bearing lubricating path 43 and supplied therefrom to the needle bearing 7, the needle bearing is also sufficiently lubricated to prevent the operation of the needle bearing 7 in the dry state.

From the above-mentioned, even if the pump is restarted after it is stopped, the occurrence of an abnormal sound and a large noise which was conventionally caused by the dry operation can be prevented as well as the drop of durability caused by the abnormal wear of the sliding portion can be avoided.

Embodiment 2

Figure 4:
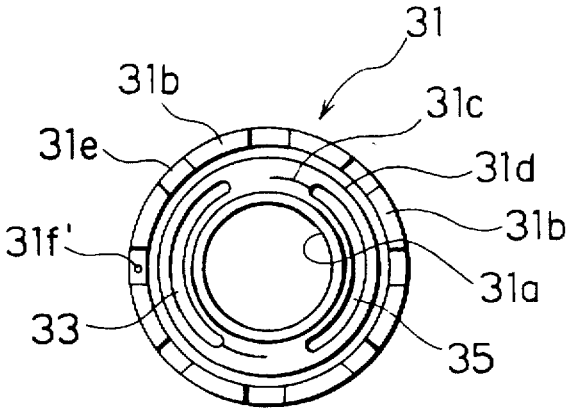
FIG. 4 is a plan view of the valve plate according to another embodiment of the present invention.
Figure 5:
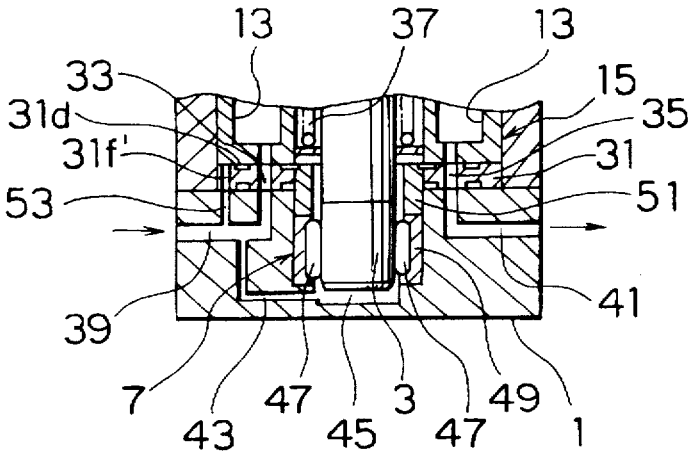
FIG. 5 is a longitudinal side cross sectional view of a portion in the vicinity of the valve plate.

FIG. 4 and FIG. 5 show a second embodiment of the present invention, wherein FIG. 4 is a plan view of a valve plate according to the embodiment and FIG. 5 is a longitudinal side cross sectional view of a portion in the vicinity of the valve plate. The arrangement and operation of the embodiment are substantially the same as those of the first embodiment except that a lubricating hole **31*f*' is not disposed to the annular groove as in the first embodiment shown in FIG. 2 but disposed to the cutout groove 31*e* of the outer peripheral land portion 31*b*. In the embodiment, the outer peripheral land portion 31*b* can be sufficiently and securely lubricated by supplying the operating fluid to the cutout groove 31*e* of the outer peripheral groove 31*b***.

Embodiment 3

Figure 6:
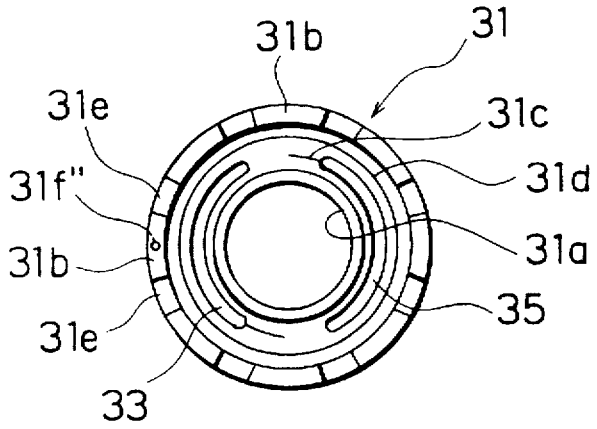
FIG. 6 is a plan view of the valve plate according to a further embodiment of the present invention.
Figure 7:
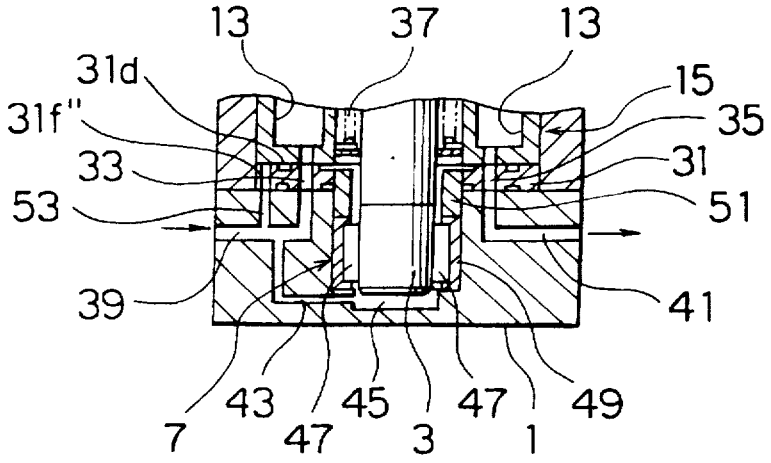
FIG. 7 is a longitudinal side cross sectional view of a portion in the vicinity of the valve plate.
Figure 8:
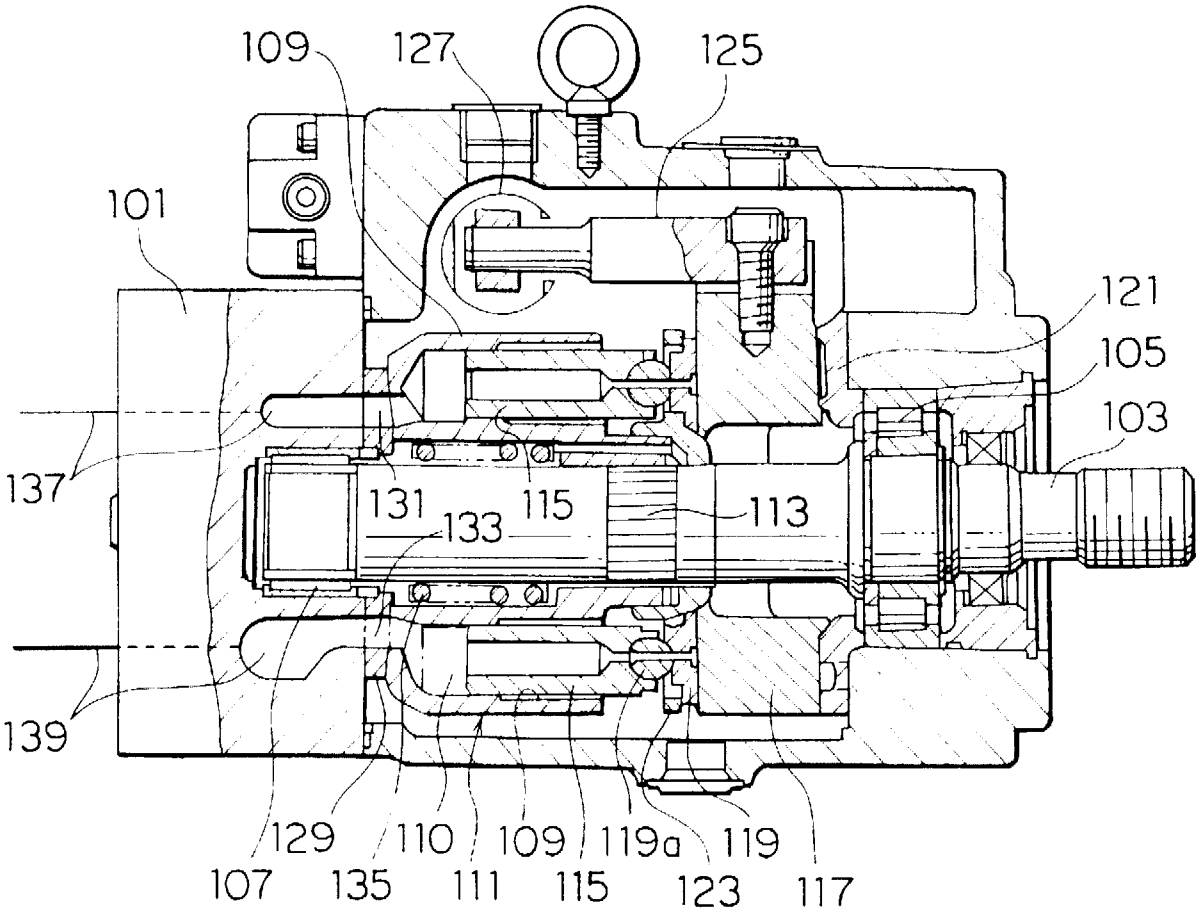
FIG. 8 is a longitudinal side cross sectional view of a conventional swash plate type axial pump including a lubricaion mechanism.

FIG. 6 and FIG. 7 show a third embodiment of the present invention, wherein FIG. 6 is a plan view of a valve plate according to the embodiment and FIG. 7 is a longitudinal side cross sectional view of a portion in the vicinity of the valve plate. The arrangement and operation of the embodiment are substantially the same as those of the first embodiment except that a lubricating hole **31*f*" is not disposed to the annular groove 31*d* as in the first embodiment shown in FIG. 2 but disposed to the outer peripheral land portion 31*b*. In this embodiment, the outer peripheral land portion 31*b*** can be more sufficiently and securely lubricated by directly supplying the operating fluid to the sliding surface thereof.

As described above, according to the present invention, the sliding surface between the valve plate and the bottom of the cylinder block can be securely and sufficiently lubricated by positively supplying the operating fluid to the portion where the valve plate is in contact with the cylinder block by the lubricating means even if the pump is rotated at a high speed or even if the pump is rotated after it is stopped. Consequently, the occurrence of an abnormal sound and an increase of a noise due to the shortage of lubrication can be suppressed by preventing the dry state as well as the drop of durability of the apparatus can be suppressed by preventing abnormal wear.

Further, since the operating fluid is positively supplied to the bearing rotatively supporting the end of the rotary shaft near to the valve plate from the suction path in the cabinet through the bearing lubricating path, the bearing can be securely and sufficiently lubricated.

What is claimed is:

1. A swash plate type axial pump comprising:

a housing;

a rotary shaft mounted for rotation in said housing;

a swash plate mounted in said housing and fixable at an incline with respect to an axis of said rotary shaft;

a cylinder block attached to said rotary shaft so as to be axially slidable relative to said rotary shaft and rotated integrally with said rotary shaft said cylinder block including a plurality of cylinders, each having a pump chamber partitioned therein;

a plurality of pistons, each slidably engaged with one of said plurality of cylinders and coupled to a shoe abutted against said swash plate;

a suction path provided in said housing for supplying an operating fluid into the pump chambers in said plurality of cylinders;

a discharge path provided in said housing for discharging the operating fluid from the pump chambers in said plurality of cylinders;

a valve plate having a first end surface abutted against an inner surface of said housing and a second end surface abutted against a bottom of said cylinder block, and said valve plate having a suction port and a discharge port for causing said suction path and said discharge path to selectively communicate with the pump chambers in said plurality of cylinders; and lubrication means for supplying a lubricant through said valve plate and directly to said second end surface, thereby lubricating the surfaces of said valve plate in contact with the bottom of said cylinder block.

2. A swash plate type axial pump according to claim 1, wherein said lubrication means comprises a through bore provided in said valve plate with a first opening of said through bore communicating with said suction path and a second opening of said through bore provided in said second end surface.

3. A swash plate type axial pump according to claim 2, wherein said valve plate has a center hole through which said rotary shaft passes, an outer peripheral land portion provided on said second end surface, a seal land portion provided on said second end surface between said center hole and said outer peripheral land portion, said suction port and said discharge port defined by shaped slots passing through said seal land portion for communicating said suction path and said discharge path with the pump chambers in said plurality of cylinders, an annular groove provided between said outer peripheral land portion and said seal land portion, and the second opening of said through bore is provided in said annular groove.

4. A swash plate type axial pump according to claim 2, wherein said valve plate has a center hole through which said rotary shaft passes, an outer peripheral land portion provided on said second end surface , a seal land portion provided on said second end surface between said center hole and said outer peripheral land portion, said suction port and said discharge port defined by shaped slots passing through said seal land portion for communicating said suction path and said discharge path with the pump chambers in said plurality of cylinders, an annular groove provided between said outer peripheral land portion and said seal land portion and the second opening of said through bore is provided in said outer peripheral land portion.

5. A swash plate type axial pump according to claim 2, wherein said valve plate has a center hole through which said rotary shaft passes, an outer peripheral land portion provided on said second end surface, at least one cutout portion provided in said outer peripheral land portion, a seal land portion provided on said second end surface between said center hole and said outer peripheral land portion, said suction port and said discharge port defined by shaped slots passing through said seal land portion for communicating said suction path and said discharge path with the pump chambers in said plurality of cylinders, an annular groove provided between said outer peripheral land portion and said seal land portion, and the second opening of said through bore is provided in said at least one cutout groove.

6. A swash plate type axial pump according to claim 1, wherein a bearing lubricating path is provided in said housing to supply said operating fluid to a bearing that rotatively supports said rotary shaft proximate to said valve plate from said suction path in said housing.

7. A valve plate, comprising:

an annular body having a center hole;

an outer peripheral land portion provided on an end surface of said annular body;

a seal land portion provided on the end surface of said annular body between said center hole and said outer peripheral land portion;

a suction port and a discharge port provided in said seal land portion by passing an arc shaped slot therethrough;

a continuous annular groove provided between said outer peripheral land portion and said seal land portion; and a lubricating hole provided through said annular body which opens into said continuous annular groove.

8. A valve plate, comprising:

an annular body having a center hole;

an outer peripheral land portion provided on an end surface of said annular body;

a lubricating hole through said annular body which has an opening provided in said outer peripheral land portion;

a seal land portion provided on said end surface between said center hole and said outer peripheral land portion;

a suction port and a discharge port provided in said seal land portion by passing an arc shaped slot therethrough; and a continuous annular groove provided between said outer peripheral land portion and said seal land portion.

9. A valve plate, comprising: an annular body having a center hole;

an outer peripheral land portion provided on an end surface of said annular body;

a cutout groove provided in said outer peripheral land portion;

a lubricating hole provided through said annular body which opens into said cutout groove;

a seal land portion provided on said end surface between said center hole and said outer peripheral land portion;

a suction port and a discharge port defined by arc shaped slots passing through said seal land portion; and a continuous annular groove provided between said outer peripheral land portion and said seal land portion.

* * * * *